US007769187B1

(12) United States Patent
Farrar et al.

(10) Patent No.: US 7,769,187 B1
(45) Date of Patent: Aug. 3, 2010

(54) COMMUNICATIONS CIRCUITS FOR ELECTRONIC DEVICES AND ACCESSORIES

(75) Inventors: Douglas M. Farrar, Los Altos, CA (US); Wendell B. Sander, Los Gatos, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 12/503,007

(22) Filed: Jul. 14, 2009

(51) Int. Cl.
*H04R 1/10* (2006.01)

(52) U.S. Cl. ..... 381/74; 381/384; 381/94.6

(58) Field of Classification Search ..... 381/94.1, 381/94.5, 94.6, 71.1, 71.6, 74, 309, 370, 381/384, 13, 1; 455/575.1, 575.2, 569.1; 379/419, 420, 387.01, 388.01
See application file for complete search history.

(56) References Cited

U.S. PATENT DOCUMENTS

| | | | | |
|---|---|---|---|---|
| 3,648,249 | A | 3/1972 | Goldsberry | |
| 3,746,991 | A | 7/1973 | Gautney | |
| 4,338,846 | A | 7/1982 | Pogoda | |
| 5,345,510 | A | 9/1994 | Singhi | |
| 5,388,496 | A | 2/1995 | Miller | |
| RE35,536 | E | 6/1997 | Irissou et al. | |
| 6,069,960 | A * | 5/2000 | Mizukami et al. | 381/74 |
| 6,745,014 | B1 | 6/2004 | Seibert et al. | |
| 6,988,905 | B2 | 1/2006 | Corey et al. | |
| 7,006,643 | B2 * | 2/2006 | Anderson | 381/120 |
| 7,023,983 | B2 * | 4/2006 | King | 379/388.01 |
| 7,110,799 | B1 | 9/2006 | Willins et al. | |
| 7,349,546 | B2 | 3/2008 | Ganton | |
| 2001/0050993 | A1 * | 12/2001 | Douglas | 381/71.6 |
| 2001/0053228 | A1 * | 12/2001 | Jones | 381/71.6 |
| 2002/0032047 | A1 | 3/2002 | Ingbir | |
| 2005/0190306 | A1 | 9/2005 | Lee | |
| 2005/0201568 | A1 | 9/2005 | Goyal | |
| 2006/0009868 | A1 | 1/2006 | Park | |
| 2006/0223581 | A1 | 10/2006 | Jacobs | |
| 2007/0004472 | A1 | 1/2007 | Gitzinger | |
| 2007/0177741 | A1 * | 8/2007 | Williamson | 381/71.6 |

(Continued)

FOREIGN PATENT DOCUMENTS

| | | |
|---|---|---|
| EP | 1 976 246 | 10/2008 |

(Continued)

OTHER PUBLICATIONS

"TRS connector" Wikipedia, [online], retrieved Jul. 28, 2008, <http://en.wikipedia.org/wiki/TRS_connector>.

(Continued)

*Primary Examiner*—Vivian Chin
*Assistant Examiner*—Jason R Kurr
(74) *Attorney, Agent, or Firm*—Treyz Law Group; G. Victor Treyz; David C. Kellogg

(57) ABSTRACT

Hybrid circuits for electronic devices and accessories for electronic devices are provided. One or more pairs of hybrid circuits may convey audio signals, noise cancellation audio signals, microphone signals, control signals, and other signals between an electronic device and an accessory. The hybrid circuits may include a voltage controlled current source, a differential amplifier, separate signal and ground pins, multiple ground lines, an amplifier on a ground noise sense input line that can sense ground noise that may result from parasitic resistance, and other circuitry.

18 Claims, 9 Drawing Sheets

U.S. PATENT DOCUMENTS

| | | | | |
|---|---|---|---|---|
| 2007/0178947 | A1 | 8/2007 | Kim | |
| 2007/0225049 | A1 | 9/2007 | Andrada | |
| 2008/0019546 | A1* | 1/2008 | Delano et al. | 381/300 |
| 2008/0032753 | A1* | 2/2008 | Nho | 455/569.1 |
| 2008/0039072 | A1 | 2/2008 | Bloebaum | |
| 2008/0164994 | A1 | 7/2008 | Johnson et al. | |
| 2008/0175402 | A1* | 7/2008 | Abe et al. | 381/71.6 |

FOREIGN PATENT DOCUMENTS

| | | | |
|---|---|---|---|
| WO | 9957937 | A1 | 11/1999 |
| WO | 03056790 | A1 | 7/2003 |
| WO | 2008085929 | A2 | 7/2008 |

OTHER PUBLICATIONS

Sander et al., U.S. Appl. No. 61/020,988, filed Jan. 14, 2008.
Sander et al., U.S. Appl. No. 12/203,876, filed Sep. 3, 2008.
Sander et al., U.S. Appl. No. 12/203,877, filed Sep. 3, 2008.
Sander et al., U.S. Appl. No. 12/203,879, filed Sep. 3, 2008.
Sander et al., U.S. Appl. No. 12/203,880, filed Sep. 3, 2008.
Sander et al., U.S. Appl. No. 12/203,881, filed Sep. 3, 2008.
Sander et al., U.S. Appl. No. 12/203,883, filed Sep. 3, 2008.
Sander et al., U.S. Appl. No. 12/203,886, filed Sep. 3, 2008.
Sander et al., U.S. Appl. No. 12/203,873, filed Sep. 3, 2008.
Sander et al., U.S. Appl. No. 12/481,556, filed Jun. 9, 2009.
Sander et al., U.S. Appl. No. 12/481,555, filed Jun. 9, 2009.

* cited by examiner

COMMUNICATIONS CIRCUITS FOR ELECTRONIC DEVICES AND ACCESSORIES

BACKGROUND

Electronic devices such as computers, media players, and cellular telephones typically contain audio jacks. Accessories such as headsets have mating plugs. A user who desires to use a headset with an electronic device may connect the headset to the electronic device by inserting the headset plug into the mating audio jack on the electronic device. Miniature size (3.5 mm) phone jacks and plugs are commonly used IN electronic devices such as notebook computers and media players, because audio connectors such as these are relatively compact.

Audio connectors that are commonly used for handling stereo audio have a tip connector, a ring connector, and a sleeve connector and are sometimes referred to as three-contact connectors or TRS connectors. In devices such as cellular telephones, it is often necessary to convey microphone signals from the headset to the cellular telephone. In arrangements in which it is desired to handle both stereo audio signals and microphone signals, an audio connector typically contains an additional ring terminal. Audio connectors such as these have a tip, two rings, and a sleeve and are therefore sometimes referred to as four-contact connectors or TRRS connectors.

In a typical microphone-enabled headset, a bias voltage is applied to the microphone from the electronic device over the microphone line. The microphone in the headset generates a microphone signal when sound is received from the user (i.e., when a user speaks during a telephone call). Microphone amplifier circuitry and analog-to-digital converter circuitry in the cellular telephone can convert microphone signals from the headset into digital signals for subsequent processing.

Some users may wish to operate their cellular telephones or other electronic devices remotely. To accommodate this need, some modern microphone-enabled headsets feature a button. When the button is pressed by the user, the microphone line is shorted to ground. Monitoring circuitry in a cellular telephone to which the headset is connected can detect the momentary grounding of the microphone line and can take appropriate action. In a typical scenario, a button press might be used be used to answer an incoming telephone or might be used skip tracks during playback of a media file.

In conventional arrangements, it can be difficult or impossible to convey desired signals over an audio jack and plug. For example, it may not be possible to route signals from microphones in a headset to an audio circuit in an electronic device to implement noise cancellation functions. As another example, it may not be possible to convey desired signals from an electronic device to an accessory. Problems such as these can arise at least in part because conventional arrangements for coupling cellular telephones to headsets tend to be inflexible.

SUMMARY

Electronic devices and external equipment such as headsets and other accessories may operate in a variety of operating modes. Noise cancellation microphones and ambient noise reduction circuitry may be provided in the external equipment to reduce speaker noise and microphone noise.

Circuitry in the electronic device and external equipment may include one or more pairs of hybrid circuits associated with a wired link between the electronic device and external equipment. Each hybrid circuit may include a summing amplifier and a transconductance amplifier (e.g., a current source). When unidirectional operation is desired, to support operations such as the playback of right or left channel audio, the hybrid circuits can be bypassed. When bidirectional operation is desired, the hybrid circuit pairs may be switched into use. When a path is configured for bidirectional operation, analog output signals may be conveyed in one direction while analog input signals may be conveyed in the opposite direction.

The analog output signals that are conveyed over a bidirectional path may include analog right and left channel audio signals. The analog input signals may include microphone signals. The microphone signals may include voice microphone signals and ambient noise signals from one or more noise cancelling microphones for reducing voice microphone noise or speaker noise.

The wired link may include one or more ground paths between the electronic device and external equipment. With one suitable arrangement, the wired link may include two or more ground paths from the external equipment that converge into a single ground path near a connector that couples to the electronic device. The electronic device may include an amplifier coupled to a ground noise sensing line that is connected to the ground path. The electronic device may have circuitry that receives amplified ground noise signals from the amplifier. The circuitry may use the amplified ground noise signals to reduce noise over the wired link between the electronic device and external equipment. With one suitable arrangement, the electronic device may have an audio jack and the ground noise sensing line may be directly connected to a ground connector in the audio jack in the electronic device.

Further features of the invention, its nature and various advantages will be more apparent from the accompanying drawings and the following detailed description of the preferred embodiments.

DETAILED DESCRIPTION

Figure 1:
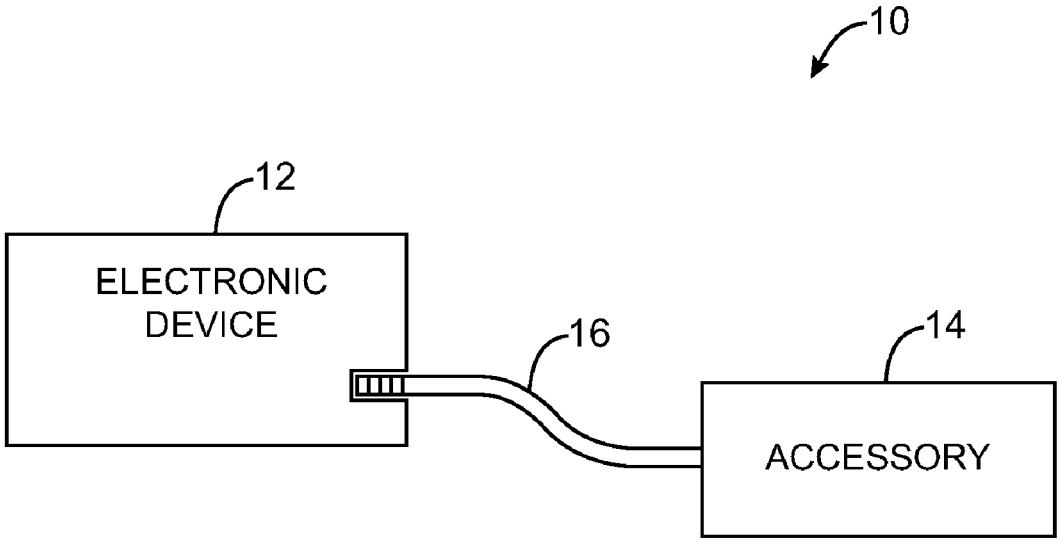
FIG. 1 is a schematic diagram of an illustrative electronic device in communication with an accessory such as a headset or other external equipment in a system in accordance with an embodiment of the present invention.

Electronic components such as electronic devices and other equipment may be interconnected using wired and wireless paths. For example, a wireless path may be used to connect a cellular telephone with a wireless base station. Wired paths may be used to connect electronic devices to equipment such as computer peripherals and audio accessories. As an example, a user may use a wired path to connect a portable music player to a headset.

Electronic devices that may be connected to external equipment using wired paths include desktop computers and portable electronic devices. The portable electronic devices may include laptop computers, tablet computers, and small portable computers of the type that are sometimes referred to as ultraportables. The portable electronic devices may also include somewhat smaller portable electronic devices such as wrist-watch devices, pendant devices, and other wearable and miniature devices.

The electronic devices that are connected to external equipment using wired paths may also be handheld electronic devices such as cellular telephones, media players with wireless communications capabilities, handheld computers (also sometimes called personal digital assistants), remote controllers, global positioning system (GPS) devices, and handheld gaming devices. The electronic devices may be multifunction devices. For example, an electronic device may perform the functions of a cellular telephone and a music player while running additional applications such as email applications, web browser applications, games, etc. These are merely illustrative examples.

An example of external equipment that may be connected to such electronic devices by a wired path is an accessory such as a headset. A headset typically includes a pair of speakers that a user can use to play audio from the electronic device. The accessory may have a user control interface such as one or more buttons. When a user supplies input, the input may be conveyed to the electronic device. As an example, when the user presses a button on the accessory, a corresponding signal may be provided to the electronic device to direct the electronic device to take an appropriate action. Because the button is located on the headset rather than on the electronic device, a user may place the electronic device at a remote location such as on a table or in a pocket, while controlling the device using conveniently located headset buttons.

The external equipment that is connected by the wired path may also include equipment such as a tape adapter. A tape adapter may have an audio plug on one end and a cassette at the other end that slides into a tape deck such as an automobile tape deck. Equipment such as a tape adapter may be used to play music or other audio over the speakers associated with the tape deck. Audio equipment such as the stereo system in a user's home or automobile may also be connected to an electronic device using a wired path. As an example, a user may connect a music player to an automobile sound system using a cable with a three-pin or four-pin audio connector (e.g., TRS or TRRS connectors).

In a typical scenario, the electronic device that is connected to the external equipment with the wired path may produce audio signals. These audio signals may be transmitted to the external equipment in the form of analog audio (as an example). The external equipment may include a microphone. Microphone signals (e.g., analog audio signals corresponding to a user's voice or other sounds) may be conveyed to the electronic device using the wired path. The wired path may also be used to convey other signals such as power signals and control signals. Digital data may be conveyed if desired. The digital data may include, for example, control signals, audio, display information, etc.

If the electronic device is a media player and is in the process of playing a song or other media file for the user, the electronic device may be directed to pause the currently playing media file when the user presses a button associated with attached external equipment. As another example, if the electronic device is a cellular telephone with media player capabilities and the user is listening to a song when an incoming telephone call is received, actuation of a button on an accessory or other external equipment by the user may direct the electronic device to answer the incoming telephone call. Actions such as these may be taken, for example, while the media player or cellular telephone is stowed within a user's pocket.

Accessories such as headsets are typically connected to electronic devices using audio plugs (male audio connectors) and mating audio jacks (female audio connectors). Audio connectors such as these may be provided in a variety of form factors. Most commonly, audio connectors take the form of 3.5 mm (⅛") miniature plugs and jacks. Other sizes are also sometimes used such as 2.5 mm subminiature connectors and ¼ inch connectors. In the context of accessories such as headsets, these audio connectors and their associated cables are generally used to carry analog signals such as audio signals for speakers and microphone signals. Digital connectors such as universal serial bus (USB) and Firewire® (IEEE 1394) connectors may also be used by electronic devices to connect to external equipment such as headsets, but it is often preferred to connect headsets to electronic devices using standard audio connectors such as the 3.5 mm audio connector. Digital connectors such as USB connectors and IEEE 1394 connectors can be of use where large volumes of digital data need to be transferred with external equipment such as when connecting to a peripheral device such as a printer. Optical connectors, which may be integrated with digital and analog connectors, may be used to convey data between an electronic device and an associated accessory, particularly in environments that carry high bandwidth traffic such as video traffic. If desired, audio connectors may include optical communications structures to support this type of traffic.

The audio connectors that may be used in connecting an electrical device to external equipment may have a number of contacts. Stereo audio connectors typically have three contacts. The outermost end of an audio plug is typically referred to as the tip. The innermost portion of the plug is typically referred to as the sleeve. A ring contact lies between the tip and the sleeve. When using this terminology, stereo audio connectors such as these are sometimes referred to as tip-ring-sleeve (TRS) connectors. The sleeve can serve as ground. The tip contact can be used in conjunction with the sleeve to handle a left audio channel and the ring contact can be used in conjunction with the sleeve to handle the right channel of audio (as an example). In four-contact audio connectors an additional ring contact is provided to form a connector of the type that is sometimes referred to as a tip-ring-ring-sleeve (TRRS) connector. Four-contact audio connectors may be used to handle a microphone signal, left and right audio channels, and ground (as an example).

Electrical devices and external equipment may be connected in various ways. For example, a user may connect either a pair of stereo headphones or a headset that contains stereo headphones and a microphone to a cellular telephone audio jack. Electrical devices and external equipment may also be operated in various modes. For example, a cellular telephone may be used in a music player mode to play back stereo audio to a user. When operated in telephone mode, the same cellular telephone may be used to play telephone call left and right audio signals to the user while simultaneously processing telephone call microphone signals from the user. Some headsets may have noise cancellation functionality. When operated in noise cancellation mode, ambient noise signals that are gathered by the headset may be processed locally or may be routed to the electronic device to implement noise reduction.

Electronic devices and external equipment may be provided with path configuration circuitry that allows the electronic devices and external equipment to be operated in a variety of different operating modes in a variety of different combinations. When, for example, a user connects one type of accessory to an electronic device, the path configuration circuitry may be adjusted to form several unidirectional paths between the electronic device and the accessory. When the user connects a different type of accessory to the electronic device or desires to operate the device and accessory in a different mode, the path configuration circuitry may be adjusted to form one or more bidirectional paths in place of one or more of the unidirectional paths. The path configuration circuitry may also be used to configure the wired path between an electronic device and attached external equipment to convey power signals or digital data in place of analog signals such as audio. Combinations of these arrangements may also be used.

An illustrative system in which an electronic device and external equipment with path configuration circuitry may communicate over a wired path is shown in FIG. 1. As shown in FIG. 1, system 10 may include an electronic device such as electronic device 12 and external equipment 14. External equipment 14 may be equipment such as an automobile with a sound system, consumer electronic equipment such as a television or audio receiver with audio capabilities, a peer device (e.g., another electronic device such as device 12), or any other suitable electronic equipment. In a typical scenario, which is sometimes described herein as an example, external equipment 14 may be an accessory such as a headset. External equipment 14 is therefore sometimes referred to as "accessory 14." This is, however, merely illustrative. Accessory 14 may be any suitable electronic equipment if desired.

A path such as path 16 may be used to connect electronic device 12 and accessory 14. In a typical arrangement, path 16 includes one or more audio connectors such as 3.5 mm plugs and jacks or audio connectors of other suitable sizes. Conductive lines in path 16 may be used to convey signals over path 16. There may, in general, be any suitable number of lines in path 16. For example, there may be two, three, four, five, or more than five separate lines. These lines may be part of one or more cables. Cables may include solid wire, stranded wire, shielding, single ground structures, multi-ground structures, twisted pair structures, or any other suitable cabling structures. Extension cord and adapter arrangements may be used as part of path 16 if desired. In an adapter arrangement, some of the features of accessory 14 such as user interface and communications functions may be provided in the form of an adapter accessory with which an auxiliary accessory such as a headset may be connected to device 12.

Accessory 14 may be any suitable equipment or device that works in conjunction with electronic device 12. Examples of accessories include audio devices such as audio devices that contain or work with one or more speakers. Speakers in accessory 14 may be provided as earbuds or as part of a headset or may be provided as a set of stand-alone powered or unpowered speakers (e.g., desktop speakers). Accessory 14 may, if desired, include audio-visual (AV) equipment such as a receiver, amplifier, television or other display, etc. Devices such as these may use path 16 to receive audio signals from device 12. The audio signals may, for example, be provided in the form of analog audio signals that need only be amplified or passed to speakers to be heard by the user of device 12. One or more optional microphones in accessory 14 may pass analog microphone signals to device 12. For example, one microphone may be used to gather voice signals from a user, while one, two, or more than two additional microphones may be used to gather ambient noise signals to implement noise cancellation functions. Buttons or other user interface devices may be used to gather user input for device 12. The use of these and other suitable accessories in system 10 is merely illustrative. In general, any suitable external equipment may be used in system 10 if desired.

Electronic device 12 may be a desktop or notebook computer, a portable electronic device such as a tablet computer or handheld electronic device that has wireless capabilities, equipment such as a television or audio receiver, or any other suitable electronic equipment. Electronic device 12 may be provided in the form of stand-alone equipment (e.g., a handheld device that is carried in the pocket of a user) or may be provided as an embedded system. Examples of systems in which device 12 may be embedded include automobiles, boats, airplanes, homes, security systems, media distribution systems for commercial and home applications, display equipment (e.g., computer monitors and televisions), etc.

In a typical scenario, device 12 may be, as an example, a handheld device that has media player and cellular telephone capabilities. Accessory 14 may be a headset with one or more microphones and a user input interface such as a button-based interface for gathering user input. Path 16 may be a four or five conductor audio cable that is connected to devices 12 and 14 using 3.5 mm audio jacks and plugs (as an example).

While paths such as path 16 may be based on commonly available digital connectors such as USB or IEEE 1394 connectors, it may be advantageous to use standard audio connectors such as a 3.5 mm audio connector to connect device 12 to accessory 14. Connectors such as these are in wide use for handling audio signals. As a result, many users have a collection of headsets and other accessories that use 3.5 mm audio connectors. The use of audio connectors such as these may therefore be helpful to users who would like to connect their existing audio equipment to device 12. Consider, as an example, a user of a media player device. Media players are well known devices for playing media files such as audio files and video files that contain an audio track. Many owners of media players own one or more headsets that have audio plugs that are compatible with standard audio jacks. It would therefore be helpful to users such as these to provide device 12 with such a compatible audio jack, notwithstanding the potential availability of additional ports such as USB and IEEE 1394 high speed digital data ports for communicating with external devices.

To accommodate different types of headsets and different types of operation, the circuitry in device 12 and accessory 14 may be configurable. For example, electronic device 12 and accessory 14 may include adjustable path configuration circuitry that can be configured to selectively connect different circuit components to the various contacts in the audio connectors as needed.

The path configuration circuitry may be adjusted to support different modes of operation. These different modes of operation may result from different combinations of accessories and electronic devices, scenarios in which different device applications are active, etc. With one suitable configuration, the path configuration circuitry may include hybrid circuits that can be selectively switched into use. When the hybrid circuits are not actively used, the communications line to which they are connected may be used primarily or exclusively for unidirectional analog signal communications (e.g., audio communications). When the hybrid circuits are switched into active use, the same communications line may be used to support bidirectional audio signals or other analog signals (e.g., an outgoing left or right audio channel in one direction and an incoming microphone signal in the opposite direction).

Because unidirectional paths may be selectively converted into bidirectional paths, it is possible to accommodate additional signals over the wired path between electronic device 12 and accessory 14. These additional signals may include power signals (e.g., a power supply voltage that the external equipment provides to electronic device 12 to charge a battery in device 12 or a power supply voltage that device 12 supplies to external equipment 14 to power circuitry such as noise cancellation circuitry), data signals (e.g., analog or digital audio signals or signals for display or control functions), user input signals (e.g., signals from button presses or other user input activity), sensor signals, or other suitable signals.

Figure 2:
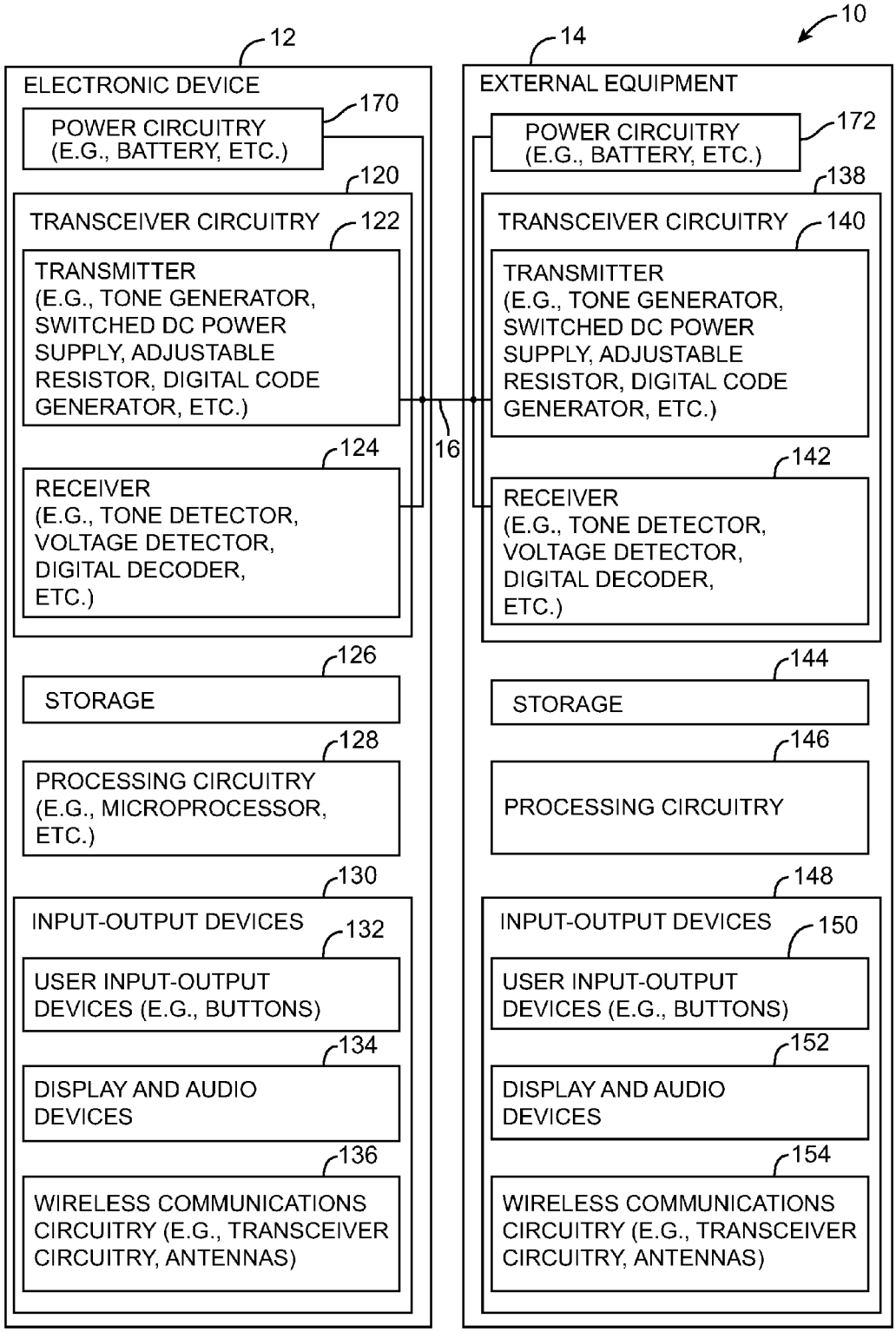
FIG. 2 is a schematic diagram showing illustrative circuitry that may be used in an electronic device and an associated accessory or other external equipment in accordance with an embodiment of the present invention.

A generalized diagram of an illustrative electronic device 12 and accessory 14 is shown in FIG. 2. In the FIG. 2 example, device 12 and accessory 14 are shown as possibly including numerous components for supporting communications and processing functions. If desired, some of these components may be omitted, thereby reducing device cost and complexity. The inclusion of these components in the schematic diagram of FIG. 2 is merely illustrative.

Device 12 may be, for example, a computer or handheld electronic device that supports cellular telephone and data functions, global positioning system capabilities, and local wireless communications capabilities (e.g., IEEE 802.11 and Bluetooth®) and that supports handheld computing device functions such as internet browsing, email and calendar functions, games, music player functionality, etc. Accessory 14 may be, for example, a headset with or without one or more microphones, a set of stand-alone speakers, audio-visual equipment, an adapter, an external controller (e.g., a keypad), a sound system such as an automobile stereo system, or any other suitable external equipment that may be connected to device 12.

As shown in FIG. 2, device 12 may include power circuitry 170 and accessory 14 may include power circuitry 172. Power circuitry 170 and 172 may include batteries such as rechargeable batteries, power adapter circuitry such as alternating current to direct current converter circuitry, battery charging circuitry, etc.

If desired, power circuitry 172 may supply power to device 12 over path 16 (e.g., to recharge a battery in device 12.). Power circuitry 172 may, for example, be provided as part of the stereo system and other electronic equipment in an automobile. An audio cable may be used to connect device 12 to the automobile stereo system (e.g., using the audio cable to form path 16). When a user plugs device 12 into the automobile's electronics in this way, power circuitry 172 in the automobile may be used to deliver direct current (DC) power to power circuitry 170 in device (e.g., to recharge a battery in device 12 through one of the conductive lines in path 16).

In other arrangements, power may be delivered from device 12 to accessory 14 over one of the lines in path 16. For example, a handheld electronic device battery in circuitry 170 of device 12 may supply power to circuitry 172 and to amplifier circuitry and other circuitry in an accessory 14 such as a headset.

By using path configuration circuitry, one or more of the lines in path 16 can be converted to power delivery lines in some situations (e.g., during certain modes of operation and when certain types of components are used) and may be converted to analog audio lines, digital data lines, or other types of lines in other situations. If desired, lines in path 16 may be used to deliver power (e.g., a relatively small amount of microphone bias power or a relatively larger amount of power for operating noise cancellation circuitry or other circuitry) while simultaneously conveying analog or digital signals (e.g., analog audio signals such as voice microphone signals or noise cancellation signals). For example, power may be delivered in one direction while analog or digital signals are conveyed in the opposite direction.

Device 12 and accessory 14 may include storage 126 and 144. Storage 126 and 144 may include one or more different types of storage such as hard disk drive storage, nonvolatile memory (e.g., flash memory or other electrically-programmable-read-only memory), volatile memory (e.g., static or dynamic random-access-memory), etc.

Processing circuitry 128 and 146 may be used with storage 126 and 144 to control the operation of device 12 and accessory 14. Processing circuitry 128 and 146 may be based on processors such as microprocessors and other suitable integrated circuits. These circuits may include application-specific integrated circuits, audio codecs, video codecs, amplifiers, communications interfaces, power management units, power supply circuits, circuits that control the operation of wireless circuitry, radio-frequency amplifiers, digital signal processors, analog-to-digital converters, digital-to-analog converters, or any other suitable circuitry.

With one suitable arrangement, processing circuitry 128 and 146 and storage 126 and 144 are used to run software on device 12 and accessory 14. The complexity of the applications that are implemented depends on the needs of the designer of system 10. For example, the software may support complex functionality such as internet browsing applications, voice-over-internet-protocol (VOIP) telephone call applications, email applications, media playback applications, operating system functions, and less complex functionality such as the functionality involved in encoding button presses as ultrasonic tones.

To support communications over path 16 and to support communications with external equipment, processing circuitry 128 and 146 and storage 126 and 144 may be used in implementing suitable communications protocols. Communications protocols that may be implemented using processing circuitry 128 and 146 and storage 126 and 144 include internet protocols, wireless local area network protocols (e.g., IEEE 802.11 protocols—sometimes referred to as Wi-Fi®), protocols for other short-range wireless communications links such as the Bluetooth® protocol, protocols for handling 3 G communications services (e.g., using wide band code division multiple access techniques), 2G cellular telephone communications protocols, serial and parallel bus protocols, etc. In a typical arrangement, more complex functions such as wireless functions are implemented exclusively or primarily on device 12 rather than accessory 14, but accessory 14 may also be provided with some or all of these capabilities if desired.

Input-output devices 130 and 148 may be used to allow data to be supplied to device 12 and accessory 14 and may be used to allow data to be provided from device 12 and accessory 14 to external destinations. Input-output devices 130 and 148 can include devices such as non-touch displays and touch displays (e.g., based on capacitive touch or resistive touch technologies as examples). Visual information may also be displayed using light-emitting diodes and other lights. Input-output devices 130 and 148 may include one or more buttons. Buttons and button-like devices may include keys, keypads, momentary switches, sliding actuators, rocker switches, click wheels, scrolling controllers, knobs, joysticks, D-pads (direction pads), touch pads, touch sliders, touch buttons, and other suitable user-actuated control interfaces. Input-output devices 130 and 148 may also include microphones, speakers, digital and analog input-output port connectors and associated circuits, cameras, etc. Wireless circuitry in input-output devices 130 and 148 may be used to receive and/or transmit wireless signals.

As shown schematically in FIG. 2, input-output devices 130 may sometimes be categorized as including user input-output devices 132 and 150, display and audio devices 134 and 152, and wireless communications circuitry 136 and 154. A user may, for example, enter user input by supplying commands through user input devices 132 and 150. Display and audio devices 134 and 152 may be used to present visual and sound output to the user. These categories need not be mutually exclusive. For example, a user may supply input using a touch screen that is being used to supply visual output data.

As indicated in FIG. 2, wireless communications circuitry 136 and 154 may include antennas and associated radio-frequency transceiver circuitry. For example, wireless communications circuitry 136 and 154 may include communications circuitry such as radio-frequency (RF) transceiver circuitry formed from one or more integrated circuits, power amplifier circuitry, passive RF components, antennas, and other circuitry for handling RF wireless signals. Wireless signals can also be sent using light (e.g., using infrared communications).

The antenna structures and wireless communications devices of devices 12 and accessory 14 may support communications over any suitable wireless communications bands. For example, wireless communications circuitry 136 and 154 may be used to cover communications frequency bands such as cellular telephone voice and data bands at 850 MHz, 900 MHz, 1800 MHz, 1900 MHz, and 2100 MHz (as examples). Wireless communications circuitry 136 and 154 may also be used to handle the Wi-Fi® (IEEE 802.11) bands at 2.4 GHz and 5.0 GHz (also sometimes referred to as wireless local area network or WLAN bands), the Bluetooth® band at 2.4 GHz, and the global positioning system (GPS) band at 1575 MHz.

Although both device 12 and accessory 14 are depicted as containing wireless communications circuitry in the FIG. 2 example, there are situations in which it may be desirable to omit such capabilities from device 12 and/or accessory 14. For example, it may be desired to power accessory 14 solely with a low-capacity battery or solely with power received through path 16 from device 12. In situations such as these, the use of extensive wireless communications circuitry may result in undesirably large amounts of power consumption. For low-power applications and situations in which low cost and weight are of primary concern, it may therefore be desirable to limit accessory 14 to low-power-consumption wireless circuitry (e.g., infrared communications) or to omit wireless circuitry from accessory 14. Moreover, not all devices 12 may require the use of extensive wireless communications capabilities. A hybrid cellular telephone and media player device may benefit from wireless capabilities, but a highly portable media player may not require wireless capabilities and such capabilities may be omitted to conserve cost and weight if desired.

Transceiver circuitry 120 and 138 may be used to support communications between electronic device 12 and accessory 14 over path 16. In general, both device 12 and accessory 14 may include transmitters and receivers. For example, device 12 may include a transmitter that produces signal information that is received by receiver 142 in accessory 14. Similarly, accessory 14 may have a transmitter 140 that produces data that is received by receiver 124 in device 12. If desired, transmitters 122 and 140 may include similar circuitry. For example, both transmitter 122 and transmitter 140 may include ultrasonic tone generation circuitry (as an example). Receivers 124 and 142 may each have corresponding tone detection circuitry. Transmitters 122 and 140 may also each have DC power supply circuitry for creating various bias voltages (which may be constant or which may be varied occasionally to convey information or to serve as a control signals), digital communications circuitry for transmitting digital data, analog signal transmission circuitry, or other suitable transmitter circuitry, whereas receivers 124 and 142 may have corresponding receiver circuitry such as voltage detector circuitry, analog components or receiver circuitry, digital receivers, etc. Symmetric configurations such as these may allow comparable amounts of information to be passed in both directions over link 16, which may be useful when accessory 14 needs to present extensive information to the user through input-output devices 148 or when extensive handshaking operations are desired (e.g., to support advanced security functionality).

It is not, however, generally necessary for both device 12 and accessory 14 to have identical transmitter and receiver circuitry. Device 12 may, for example, be larger than accessory 14 and may have available on-board power in the form of a rechargeable battery, whereas accessory 14 may be unpowered (and receiving power only from device 12) or may have only a small battery (for use alone or in combination with power received from device 12). As another example, accessory 14 may be part of a relatively complex system, whereas device 12 may be formed in a small housing that limits the amount of circuitry that may be used in device 12. In situations such as these, it may be desirable to provide device 12 and accessory 14 with different communications circuitry.

As an example, transmitter 122 in device 12 may include adjustable DC power supply circuitry. By placing different DC voltages on the lines of path 16 at different times, device 12 can communicate relatively modest amounts of data to accessory 14. This data may include, for example, data that instructs accessory 14 to power its microphone (if available) or that instructs accessory 14 to respond with an acknowledgement signal. A voltage detector and associated circuitry in receiver 138 of accessory 14 may process the DC bias voltages that are received from device 12. In this type of scenario, transmitter 140 in accessory 14 may include an ultrasonic tone generator that supplies acknowledgement signals and user input data (e.g., button press data) to device 12. A tone detector in receiver 124 may decode the tone signals for device 12. To support higher data rate transmissions between device 12 and accessory 14, device 12 may include an ultrasonic tone generator in transmitter 122 that transmits ultrasonic tones to a corresponding ultrasonic tone receiver in receiver 142 of accessory 14. If desired, patterns of tones may be transmitted by ultrasonic tone generators in transmitters 122 and 140 (e.g., patterns corresponding to particular commands or other information). These are merely illustrative examples. Device 12 and accessory 14 may include any suitable transceiver circuitry for communicating data using any suitable communications protocol if desired.

Applications running on the processing circuitry of device 12 may use decoded user input data as control signals. As an example, a cellular telephone application may interpret user input as commands to answer or hang up a cellular telephone call, a media playback application may interpret user input as commands to skip a track, to pause, play, fast-forward, or rewind a media file, etc. Still other applications may interpret user button-press data or other user input as commands for making menu selections, etc.

Figure 3:
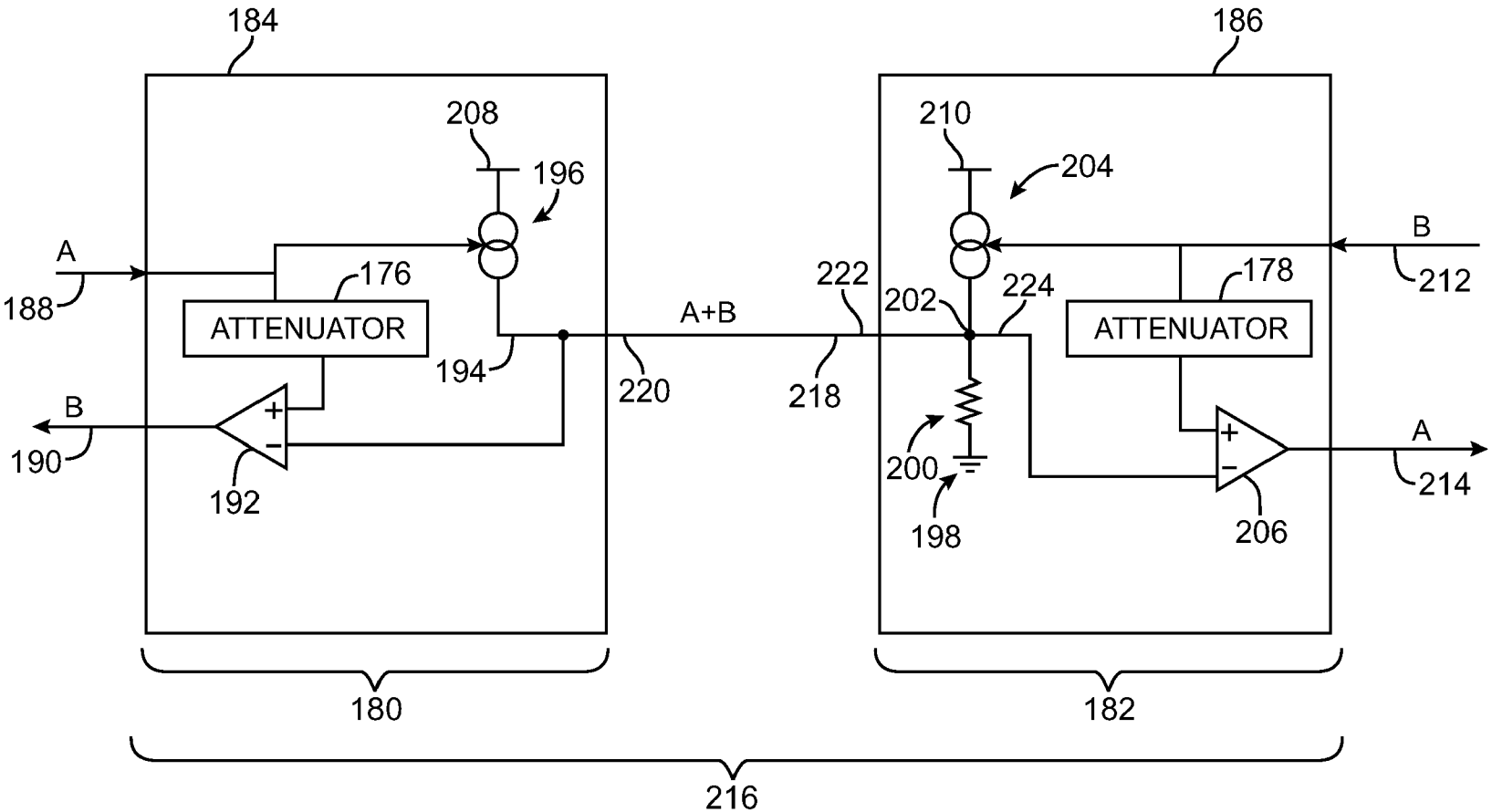
FIG. 3 is a circuit diagram showing how hybrid circuits may be used in a communications path between an electronic device and external equipment in accordance with an embodiment of the present invention.

One illustrative circuit that may be used for one or more of the lines in path 16 is the circuitry of FIG. 3. Circuitry 216 of FIG. 3 may include circuitry such as circuitry 180 that is located in device 12 and circuitry such as circuitry 182 that is located in accessory 14. Line 218 may be one of the lines in path 16. Ground node 198 may be provided with a ground voltage (e.g., from accessory 14 and/or from device 12). Node 198 and resistor 200 may be located in accessory 14 or in device 12. For example, node 198 and resistor 200 may be located in accessory 14 and may be coupled to a ground voltage source such as a ground line in path 16. As another example, node 198 may be located in device 12 and resistor 200 may be located in accessory 14.

When configured as shown in FIG. 3, the circuitry of FIG. 3 may support bidirectional communications. The signals that are conveyed over path 218 in FIG. 3 may, for example, be analog signals such as microphone signals or left or right channel audio signals. Signals such as these typically lie in a frequency range of about 20 Hz to 20 kHz. If desired, ultrasonic signals (e.g., tones above 20 kHz in frequency such as 75 kHz to 300 kHz tones) may be conveyed over path 218. Still other signals such as digital pulses or tones or other signals in normal audio frequency ranges may be conveyed if desired.

Circuitry 216 may include circuits 184 and 186 (sometimes referred to as "hybrids"). Circuit 184 has input port 188 and output port 190. Common port 220 serves as both an input and an output for circuit 184. Current source 196 is connected between line 194 and power supply 208 and is modulated by the input signal on input 188. Circuit 186 has input port 212 and output port 214. Common port 222 serves as both an input and an output for circuit 186. Modulated current source 204 is connected between line 224 and power supply 210 and is controlled by the magnitude of the input signal on input 212.

In the example of FIG. 3, circuit 184 receives an input voltage signal A on input 188 and circuit 186 receives an input voltage signal B on input 212. In response, a current proportional to A flows through current source 196 and a current proportional to B flows through current source 204. A resulting sum current that is proportional to A+B flows from node 202 to ground node 198 via resistor 200 and produces a voltage that is proportional to the sum of voltages A and B (i.e., the voltage at node 202 is proportional to A+B as shown in FIG. 3). Because the voltage at node 202 is equal to the sum of A and B, a node such as node 202 may sometimes be referred to as a summing node and a resistor such as resistor 200 may sometimes be referred to as a summing resistor. Current sources 196 and 204 are controlled by input voltages and may therefore sometimes be referred to as transconductance amplifiers (i.e., amplifiers that receive input voltages and that produce corresponding output currents).

Circuit 184 has a summing circuit such as difference amplifier 192 with a negative input (−) and a positive input (+). This type of circuit may also be referred to as a summer, a differential amplifier circuit, a mixer, etc. The positive input of amplifier 192 receives the signal A from input 188 (e.g., from attenuator 176) while the negative input receives the common signal A+B from common input 220. The resulting output of amplifier 192 is proportional to signal B and is provided to output 190. In circuitry 186, the negative input of amplifier 206 receives the common signal A+B from common input 222 while the positive input of amplifier 206 receives the signal B from input 212 (e.g., via attenuator 178). A corresponding output proportional to signal A is produced by amplifier 206 and is routed to output 214, as shown in FIG. 3.

Optionally, circuit 184 may have an attenuator circuit such as circuit 176 and circuitry 186 may have an attenuator circuitry such as circuit 178. With this type of arrangement, the gains of current sources 196 and 204 and the resistance of summing resistor 200 may be selected to match the attenuator circuits 176 and 178. As one example, circuit 176 may reduce the voltage of signal A received by amplifier 192 by one-fourth and circuit 178 may reduce the voltage of signal B received by amplifier 206 by one-fourth. The gain ($g_m$) of current source 196 may be approximately equal to the gain ($g_m$) of current source 204 (e.g., the amount of current the current source produces as a function of the input voltage). In addition, the gain ($g_m$) of current sources 196 and 204 and the resistance (R) of resistor 200 may be configured such that the product of the gain ($g_m$) and the resistance (R) of resistor 200 is approximately equal to 0.25 (e.g., $g_m$*R=¼). In this example, the common signal A+B on line 218 may be approximately equal to A/4+B/4 and the signals A and B on outputs 214 and 190 may be approximately equal to A/4 and B/4, respectively.

Device 12 and accessory 14 may, if desired, include path configuration circuitry such as switches and other configurable circuitry. The path configuration circuitry may be configured to selectively switch circuitry such as circuitry 216 of FIG. 3 into use or out of use as desired. In situations in which the bidirectional nature of path 216 is desired, path configuration circuitry may be adjusted to switch circuits such as circuits 184 and 186 into use and thereby selectively form a directional path between device 12 and accessory 14. In other situations, where only a unidirectional path is desired, the path configuration circuitry can be adjusted to switch circuits 184 and 186 out of use.

Circuitry 216 supports bidirectional (full duplex) communications. Device 12 may supply signal A to accessory 14 while accessory 14 simultaneously supplies signal B to device 12. Signal A may sometimes be referred to herein as an output (OUT) signal as signal A is output by device 12 to accessory 14 and signal B may sometimes be referred to herein as an input (IN) signal as signal B is received by device 12 from accessory 14. The signals that are transmitted in this way may be, for example, analog audio signals (e.g., analog signals in the audible frequency range of 20 Hz to 20 kHz), ultrasonic tones (e.g., tones at frequencies above 20 kHz that may be used alone or in patterns to represent control data or other signals), digital data, etc. The voltage that is supplied to power supply 210 may be conveyed over a separate power line in path 16. If desired, the power line may also be used to bias a microphone in accessory 14 and to provide power to circuitry in accessory 14.

Circuit pairs such as the pair of circuits of FIG. 3 may be included in one of the lines in path 16, in two of the lines in path 16, or in more than two of the lines in path 16. For example, circuitry 216 may include two pairs of hybrid circuits that provide two separate bidirectional communications paths. With this type of arrangement, circuitry 216 can simultaneously convey analog audio output (e.g., left and right channels of audio playback for accessory 14), ambient noise signals (e.g., signals from microphones in accessory 14 used by device 12 to produce noise cancellation signals in the analog audio output), and positive and ground power supply voltages (e.g., to power circuitry in accessory 14). With another implementation, circuitry 216 can simultaneously convey analog audio output (e.g., left and right channels of audio playback for accessory 14), microphone input (e.g., microphone signals and microphone ambient noise signals for device 12), and positive and ground power supply voltages (e.g., to power circuitry in accessory 14).

Figure 4:
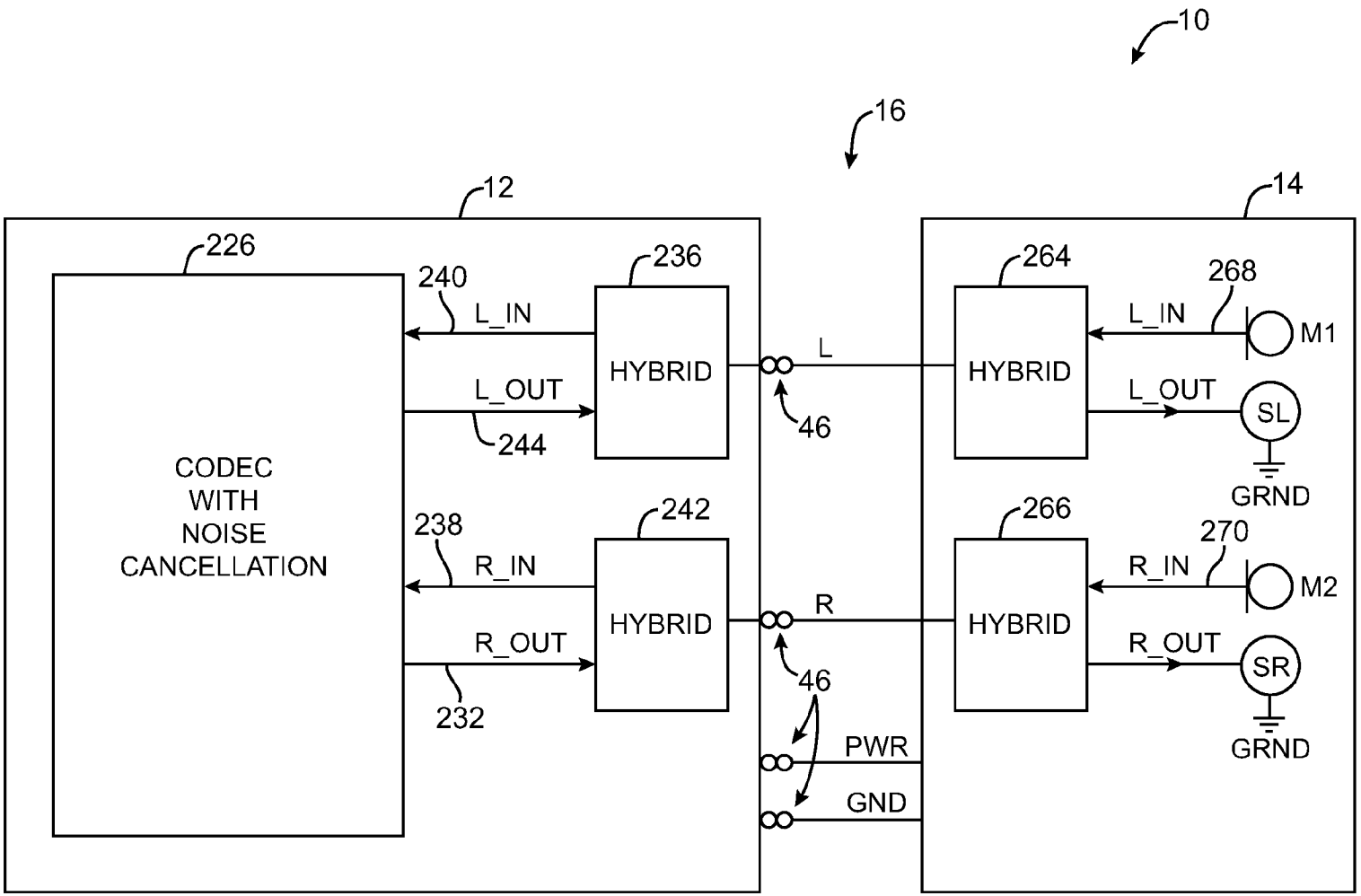
FIG. 4 is a circuit diagram showing how pairs of hybrid circuits may be used in an electronic device and external equipment in an arrangement in which the hybrid circuits convey audio signals such as ambient noise signals and stereo audio signals in accordance with an embodiment of the present invention.

FIG. 4 shows an illustrative circuit configuration in which the left and right audio lines in path 16 have been provided with hybrid pairs. Audio connectors 46 may have four contacts each (i.e., tip, ring, ring, and sleeve contacts in a 3.5 mm connector pair). These contacts and the associated lines in the path 16 between device 12 and equipment 14 are labeled as L (left audio), R (right audio), PWR (power), and GND (ground). In the FIG. 4 example, hybrids 236 and 264 form a first hybrid pair and hybrids 242 and 266 form a second hybrid pair. The first hybrid pair can be selectively switched into the left channel (L) audio path when it is desired to make the left channel path directional. When the first hybrid pair is not needed, a left channel bypass path may be switched into use. The second hybrid pair can likewise be selectively switched into the right channel (R) audio path when it is desired to make the right channel path bidirectional path. A right channel bypass path can be switched into use to bypass the second hybrid pair when the second hybrid pair is not needed.

The bidirectional paths formed by the first and second hybrid pairs can be used to convey any suitable signals between device 12 and accessory 14. In the FIG. 4 example, the bidirectional L and R paths are being used to route left and right audio from device 12 to accessory 14 while microphone signals are simultaneously being routed from accessory 14 to device 12. The microphone signals may include, for example, voice microphone signals and noise cancellation microphone signals.

Device 12 may have one or more circuits such as circuit 226. Circuit 226 may include storage and processing circuitry and may be implemented using one or more integrated circuits and other suitable circuit components. With one suitable arrangement, which is sometimes described as an example, circuit 226 may include an audio integrated circuit (sometimes referred to as a codec). Circuit 226 may generate right channel audio output (R_OUT) on right channel audio output 232 and can generate left channel audio output (L_OUT) on left channel audio output 244.

Audio input can be received at audio inputs 238 and 240. Analog-to-digital converter circuitry in circuit 226 can be used to digitize incoming audio signals. These signals can then be processed by the other storage and processing circuitry in device 12. Circuit 226 may include active noise reduction circuits that use noise cancellation signals received using audio inputs 238 and 240 to remove noise from the left and right channel audio outputs (L_OUT and R_OUT). If desired, the active noise reduction circuits may include one or more differential amplifiers that can subtract the noise cancellation signals received using audio input 238 from the right channel audio output (R_OUT) and can subtract the noise cancellation signals received using audio input 240 from the left channel audio output (L_OUT).

The incoming audio signals on inputs 238 and 240 may correspond to microphone signals. Accessory 14 may have microphones such as microphones M1 and M2. Accessory 14 may also have a right-channel speaker such as speaker SR and a left-channel speaker such as speaker SL. Microphones M1 and M2 may be mounted in the vicinity of speakers SL and SR, respectively. In this type of configuration, microphones M1 and M2 may pick up ambient noise in the vicinity of speakers SL and SR and may therefore serve as noise cancelling microphones for speakers SL and SR, respectively. As another example, microphone M1 may be used to monitor the user's voice and microphone M2 may be used to pick up ambient noise in the vicinity of microphone M1, so that the microphone signals from microphone M2 can be used to reduce noise for microphone M1.

Noise cancellation operations can, in general, be implemented locally in accessory 14 or remotely in device 12. In the FIG. 4 arrangement, remote noise reduction for speakers SL and SR can be implemented using signals from noise reductions microphones M1 and M2 (e.g., using the hardware of device 12 such as circuit 226). Signals from microphone M1 may be received by hybrid circuit 264 on input 268 and conveyed to hybrid circuit 236 over left channel audio path (L). Signals from microphone M2 may be received by hybrid circuit 266 on input 270 and conveyed to hybrid circuit 242 over right channel audio path (R). While microphone signals are routed from microphone M1 to input 240 over the left channel audio path (L) using hybrids 236 and 264, audio output signals from the left channel audio output 244 may be routed in the opposite direction over the same path. Likewise, while microphone signals are routed from microphone M2 to input 238 over the right channel audio path (R) using hybrids 242 and 266, audio output signals from the right channel audio output 232 may be routed in the opposite direction over the same path.

When noise cancellation functions are implemented remotely in device 12, circuit 226 can implement noise cancellation functions (e.g., subtraction functions in which ambient noise is removed from the voice microphone) using the relatively extensive processing capabilities available in circuit 226 and device 12, thereby reducing the processing burden on the circuitry of accessory 14.

While microphone signals from M1 and M2 are being conveyed from accessory 14 to device 12, audio signals may be routed over the right and left channel audio lines to speakers SR and SL. The audio signals may be separate left and right channel audio signals or may be a mono signal that has been replicated on both channels. The audio signals may correspond to any suitable content such as a voice in a voice telephone call or a media file in a media playback operation.

The operation of the transconductance amplifiers and summers in the hybrids consumes power. Power can be conserved and high-quality audio playback can be obtained by bypassing the hybrid circuits when bidirectionality is not required. As an example, the hybrids may be bypassed when microphones M1 and M2 are not being used (e.g., when noise cancellation functions are disabled), but audio playback is still desired. With another example, the hybrids may be bypassed when supporting legacy accessories (i.e., accessories without extensive noise cancellation functions or other capabilities that draw larger amounts of power). Lower-power modes can also be used when it is desired to conserve battery power. In this type of example, the power (PWR) line in path 16 may provide a relatively high-impedance power supply voltage that can be used as a microphone bias signal.

The power (PWR) and ground (GND) lines in the path 16 may convey power supply signals between device 12 and accessory 14. Accessory 14 may use the power supply signals on the power (PWR) and ground (GND) lines in path 16 to generate microphone bias signals and other power supply voltages in accessory 14. The power supply signals from the power (PWR) and ground (GND) lines may be used to power left and right audio amplifiers (e.g., to amplify the L_OUT and R_OUT signals for the left and right speakers SL and SR), hybrid circuits, audio processing circuits, displays, and other circuits and components in accessory 14 (as examples).

Figure 5:
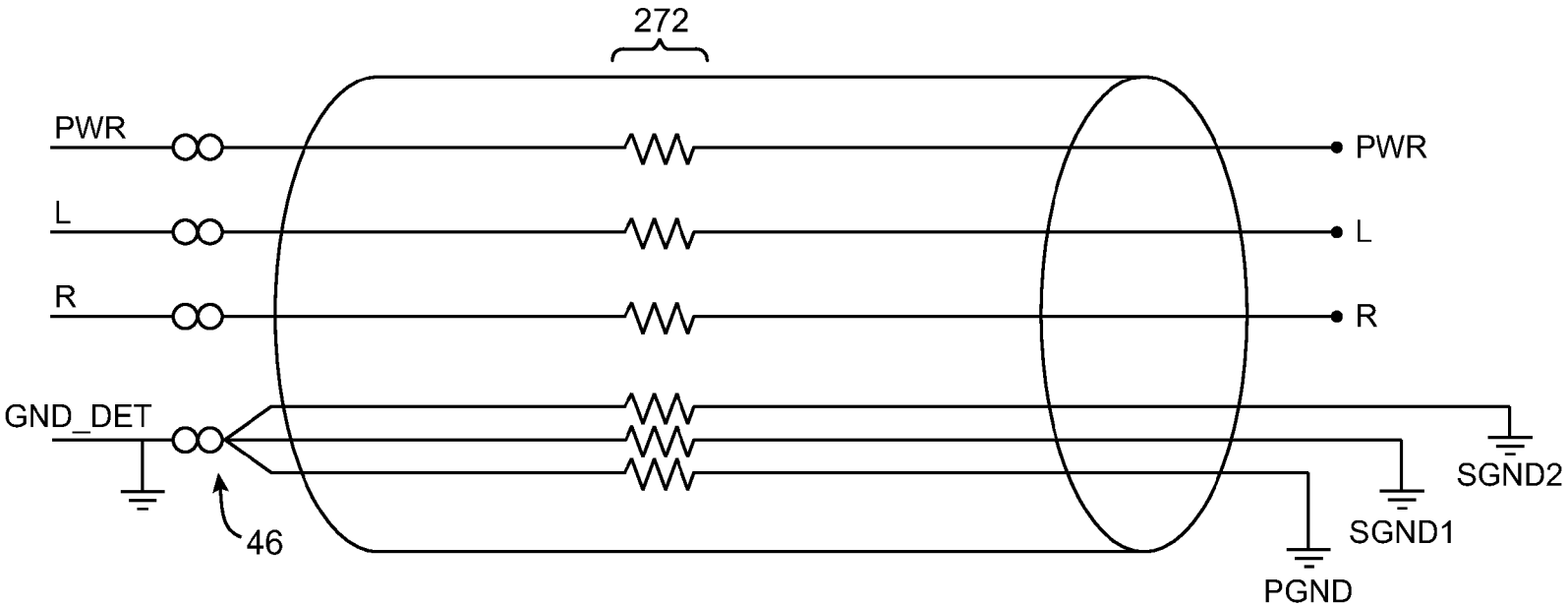
FIG. 5 is a diagram showing how a communications path between an electronic device and external equipment may include multiple ground lines that are connected together at one end of the communications path in accordance with an embodiment of the present invention.

With one suitable arrangement, the ground line (GND) in path 16 may include two or more separate ground lines that converge near the ground audio connector 46 as illustrated in the example of FIG. 5. As shown in FIG. 5, the ground line (GND) in path 16 may include a first signal ground line (SGND1), a second signal ground line (SGND2), and a power ground line (PGND) that run the length of path 16 and converge at (or just before) the ground connector 46 in path 16 that is used to connect to device 12. As shown schematically in FIG. 5, each of the lines in path 16 may have an associated non-zero resistance 272.

If desired, the power ground line (PGND) may serve as the ground line for relatively high power components in accessory 14 such as differential amplifiers, audio amplifiers, processing circuits, displays, etc. The signal ground lines (SGND1 and SGND2) may serve as the ground lines for relatively low power components in accessory 14. In particular, the signal ground lines may serve as the ground lines for components that handle signals such as L_OUT, L_IN, R_OUT, and R_IN. This type of arrangement may help to reduce noise in components that use the signal ground lines. If desired, the first signal ground line (SGND1) may be used in components that handle the left audio channel signals (L_IN and L_OUT) and the second signal ground line (SGND2) may be used in components that handle the right audio channel signals (R_IN and R_OUT). This helps to reduce cross talk.

Device 12 may include circuitry that monitors ground signals on the ground audio connector 46 in device 12. As one example, a ground detect line (GND_DET) may be connected to the ground audio connector 46 in device 12 as shown in FIG. 5 to sense variations in the voltage on the ground lines in path 16.

Figure 6:
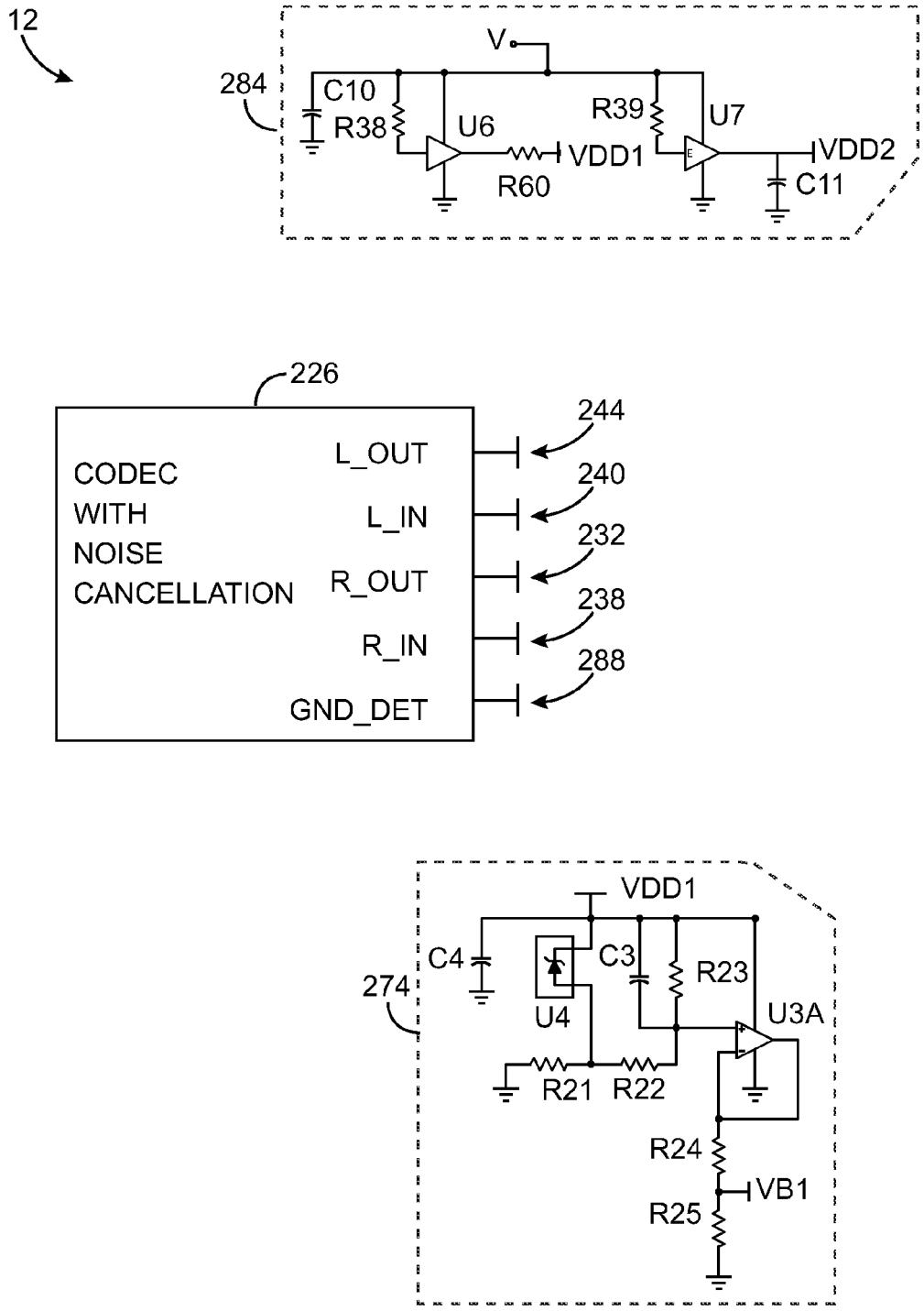
FIG. 6 is a circuit diagram of illustrative circuitry that may be provided as part of an electronic device that can communicate with external equipment such as an accessory using hybrid circuits in accordance with an embodiment of the present invention.
Figure 6:
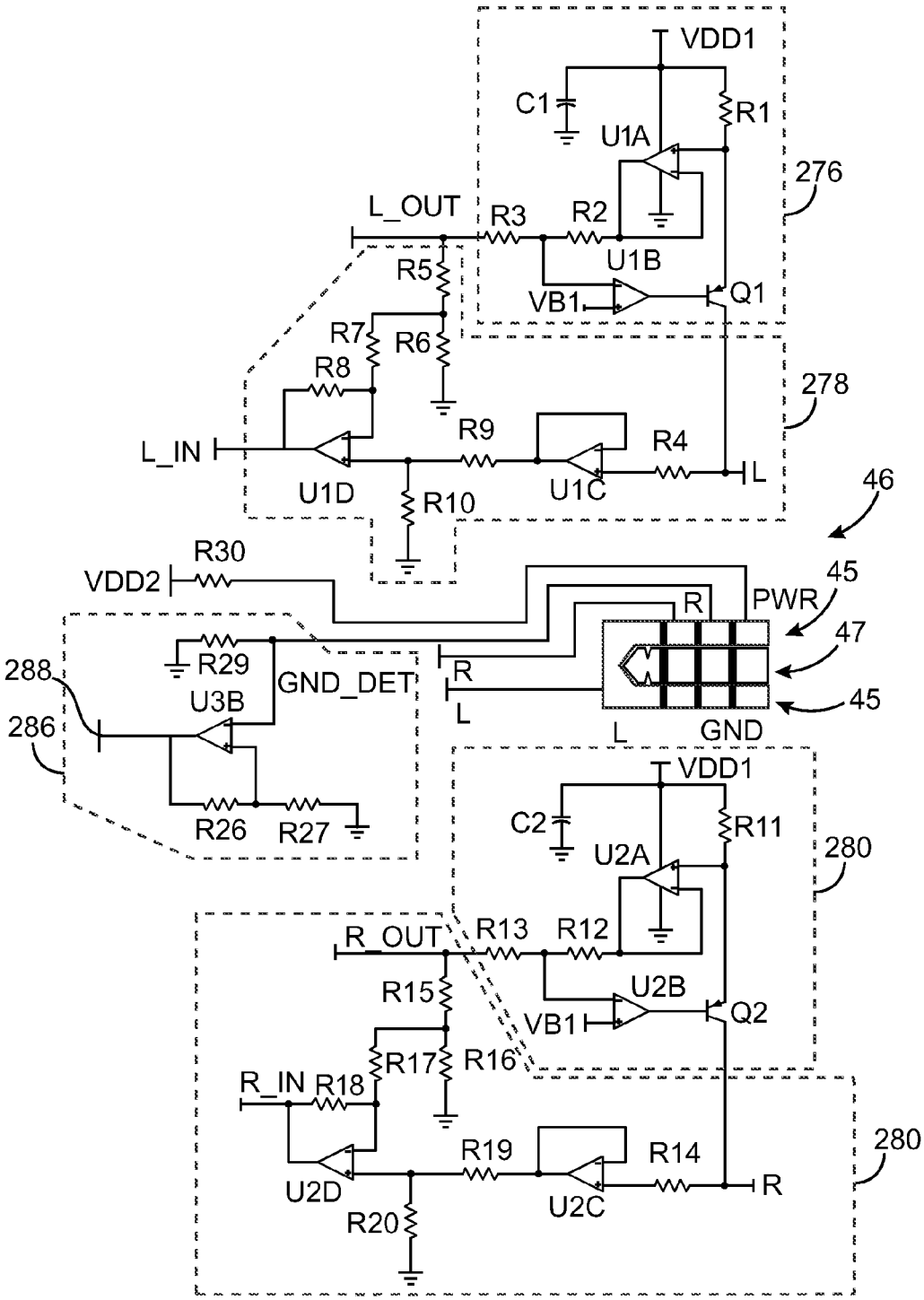

FIG. 6 shows an illustrative circuit configuration in device 12 in which a pair of hybrid circuits can be coupled to the left and right audio lines in path 16 to provide two bidirectional paths between device 12 and external equipment 14. As shown in FIG. 6, hybrid circuit 236 of FIG. 4 may be formed from circuit 276, circuit 278, and from shared circuit 274 (e.g., a circuit that produces a shared reference voltage such as reference voltage VB1). Hybrid circuit 242 may be formed from circuit 280, circuit 282, and from shared circuit 274.

Shared circuit 274 may generate one or more reference voltages such as reference voltage VB1 for circuits 276 and 280 (as examples). With one arrangement, circuit 274 may receive a power supply voltage VDD1 from device 12 and may generate the reference voltage VB1. As one example, the power supply voltage VDD1 may be 3.0 volts.

Capacitors C3 and C4 in circuit 274 may help to reduce noise in circuit 274. In general, capacitors C3 and C4 may have any suitable capacitances. The capacitances of capacitors C3 and C4 need not be equal. As one example, capacitors C3 and C4 may each have a capacitance of 1.0 microfarads (1.0 μF).

Zener diode U4 may provide a reference voltage difference between VDD1 and a node between resistors R21 and R22. With one suitable arrangement, zener diode U4 may be configured to have a breakdown voltage of approximately 1.225 volts (e.g., to maintain the node between resistors R21 and R22 within 1.225 volts of the voltage VDD1).

Resistors R22 and R23 may form a voltage divider that provides the positive input to amplifier U3A in circuit 274. In general, resistors R22 and R23 may have any suitable resistances. As one example, resistors R22 and R23 may have resistances of approximately 75.0 kilohms and 118.0 kilohms, respectively. Resistor R21 may have a resistance of approximately 22.1 kilohms (as an example). With this type of arrangement, the voltage divider formed by resistors R22 and R23 may generate a voltage at VDD1−0.75 volts and may provide the voltage to the positive input of amplifier U3A.

Amplifier U3A may receive the voltage at VDD1−0.75 volts and may be configured as a voltage follower that generates an output at VDD1−0.75 volts (e.g., the negative input of the amplifier may be coupled to the output of the amplifier). The output of amplifier U3A may be fed into a voltage divider formed by resistors R24 and R25. The output of the voltage divider may be a shared reference voltage VB1 that is used by both circuits 276 and 280. In general, resistors R24 and R25 may have any suitable resistances. Resistor R24 may have a resistance that is half the resistance of resistor R25. As one example, resistors R24 and R25 may have resistances of 22.1 kilohms and 44.2 kilohms, respectively. With this type of arrangement, the output of the voltage divider formed by resistors R24 and R25 may be two-thirds of its input (e.g., ⅔*(VDD1−0.75) volts).

Circuit 276 may be a part of hybrid circuit 236. In operation, circuit 276 may function as a current source (such as current source 196 of FIG. 3) that produces a current on the left channel (L) audio line in path 16. The current produced by circuit 276 may be proportional to the left channel audio signals (L_OUT) output by codec circuit 226. Capacitor C1 may help to reduce noise in circuit 276 and may have any suitable capacitance. As one example, capacitor C1 may have a capacitance of 1.0 microfarads. Circuit 276 may have an amplifier U1A with a positive input connected to the power supply voltage VDD1 through a resistor such as resistor R1. As one example, resistor R1 may have a resistance of 7.5 kilohms. The amplifier U1A may be configured as a voltage follower with the negative input coupled to the output of the amplifier. With one suitable arrangement, the output and negative input of amplifier U1A may be coupled to the left audio output (L_OUT) of codec 226 through resistors R2 and R3. Resistor R2 may have a resistance that is half of the resistance of resistor R3. As one example, resistors R2 and R3 may have resistance of approximately 22.1 kilohms and 44.2 kilohms, respectively. The amplifier U1A may help to prevent current from power supply line VDD1 from passing into and through resistor R2 while providing the voltage of its positive input to resistor R2.

Differential amplifier U1B may have a positive input that receives the reference voltage VB1 from circuit 274 and a negative input connected to a node between resistors R2 and R3. With this type of arrangement, when the voltage on output 244 (i.e., L_OUT) is zero, the output of amplifier U1B may be at (VDD1−0.75−VBE(Q1)) volts and the output current of transistor Q1 may be determined by dividing 0.75 volts by the resistance of resistor R1. VBE(Q1) may represent the voltage drop across the base and emitter terminals of transistor Q1. When the voltage on output 244 is nonzero, the output of amplifier U1B may be reduced by a given factor equal to the voltage of output 244 multiplied by the resistance of R2 divided by the resistance of R3. The output current of transistor Q1 in this arrangement may be reduced by the given factor divided by the resistance of resistor R1. The output of circuit 276 (i.e., the current added to left channel audio line L in path 16) may therefore be proportional to the voltage of output 244 with an additional constant (DC) bias current (e.g., the current of transistor Q1 when the voltage on output 244 is zero.

Circuit 278 may be another part of hybrid circuit 226. In operation, circuit 278 may receive signals from the left channel audio line L in path 16 and from the output 244 of circuit 226 and may generate left audio channel input signals (L_IN) for input 240 of circuit 226. Resistors R5, R6, and R7 may form an attenuator (see, e.g., attenuator circuit 176 of FIG. 3). In particular, resistors R5, R6, and R7 may reduce the voltage of signals from output 244 to one-fourth and provide the reduced voltage to the negative input of amplifier U1D. In general, resistors R5, R6, and R7 may have any suitable resistances. As one example, resistors R5, R6, and R7 may have resistances of approximately 75.0 kilohms, 24.9 kilohms, and 22.1 kilohms, respectively.

Circuit 278 may include amplifier U1C coupled to the left audio path (L) in path 16. Amplifier U1C may be configured as a voltage follower (e.g., amplifier U1C may have its negative input connected to its output). If desired, there may be a resistor such as resistor R4 located between the left audio path (L) (e.g., the tip connector 45 in device 12) and the amplifier U1C. Resistor R4 may provide electrostatic discharge (ESD) protection to device 12. Resistor R4 may have any suitable resistance and, as one example, may have a resistance of 4.7 kilohms.

Amplifier U1D may be configured as a differential amplifier that uses the difference between the voltage on the left audio path (L) and the (attenuated) voltage from the left audio output 244 to generate the input 240 for codec 226 (e.g., to receive the incoming analog signals from accessory 14 conveyed on the bidirectional path L). The differential amplifier U1D may have associated resistors R8, R9, and R10. The resistors R8, R9, and R10 may have any suitable resistances and, as one example, these resistors may have resistances of 44.2 kilohms, 22.1 kilohms, and 44.2 kilohms, respectively.

Circuits 280 and 282 may handle signals carried on the right channel audio path (R) in path 16. For example, circuits 280 and 282 may handle signals output from the right channel output (R_OUT) 232 and may generate the right channel input (R_IN) for input 238. With one suitable arrangement (as illustrated in the FIG. 6 example), circuits 280 and 282 may handle signals for the right channel in a manner equivalent to how circuits 276 and 278 handle signals for the left channel. If desired, the capacitance of capacitor C2 may be equivalent to capacitor C1. The resistances of resistors R11, R12, R13, R14, R15, R16, R17, R18, R19, and R20 may be approximately equivalent to the corresponding resistors in circuits 276 and 278. The amplifiers U2A, U2B, U2C, and U2D may be configured in a manner equivalent to amplifiers U1A, U2B, U2C, and U2D, respectively. If desired, transistor Q2 may be similar to (or identical to) transistor Q1.

If desired, device 12 may include power supply circuitry such as circuitry 284. With one suitable arrangement, circuitry 284 may convert an internal power supply voltage V to the power supply voltage VDD1 used in the circuitry of FIG. 6 and a power supply voltage VDD2 that is fed to accessory 14 over a power supply line (PWR) in path 16. With one suitable arrangement, the output of circuitry 284 may be coupled to the female power supply connector 45 (e.g., the sleeve connector in device 12). As shown schematically by resistor R30 in FIG. 6, there may be a non-zero resistance between the connector 45 in device 12 and circuitry 284. As one example, the resistance between circuitry 284 and connector 45 may be approximately 1.0 ohms.

Circuitry 284 may include capacitors C10 and C11, resistors R38 and R39, and amplifiers U6 and U7. As examples, the capacitor C10 may have a capacitance of approximately 10.0 microfarads, the capacitor C11 may have a capacitance of approximately 1.0 microfarads, and the resistors R38 and R39 may each have a resistance of approximately 14.0 kilohms. Resistor R60 is a schematic representation of the resistance between circuitry 284 and the circuits in FIG. 6 which circuitry 284 powers (e.g., resistance R60 may have a relatively small resistance).

The illustrative circuit configuration of FIG. 6 may also include a ground noise detection circuit such as circuit 286. Circuit 286 may be used to sense variations in the voltage of ground lines in path 16 (from parasitic resistances in path 16) and to generate signals associated with the variations for codec 226. With one arrangement, ground noise sensing circuit 286 may provide ground noise signals to the ground detect (GND_DET) input 288 of codec 226. Codec 226 may use the ground noise signals to reduce noise (e.g., to reduce noise in speakers SL and SR) by adjusting the outputs of the left and right channel audio outputs 355 and 232 as appropriate.

Circuit 286 may include an amplifier U3B with a positive input connected directly to the ground contact (GND) in the female connector 45 of device 12 that couples with the male ground connector 47 of accessory 14. Schematically, circuit 286 may also include resistors R26 and R27. Resistors R26 and R27 may represent the resistance between the negative input of amplifier U3B and the output of the amplifier and the ground in device 12, respectively. With one suitable arrangement, resistor R27 may have a resistance of approximately 1.0 ohms and resistor 26 may have a resistance of approximately 30 milliohms. With another suitable arrangement, resistor R27 may have any suitable resistance and resistor R26 may have a resistance that is approximately three-hundredths the resistance of resistor R27. In general, resistors R27 and R26 may have any suitable resistances.

Resistors R29 and R30 may schematically represent the resistance between the female connectors 45 of device 12 and the circuitry in device 12 connected to those connectors. As one example, resistors R29 and R30 may each have a resistance of approximately 1.0 ohms due to parasitic resistances, printed circuit board resistances, and other sources of resistance. Resistors R29 and R30 are generally not actual resistors and are shown in FIG. 6 merely to illustrate parasitic resistances that may exist in the arrangement of FIG. 6.

Figure 7:
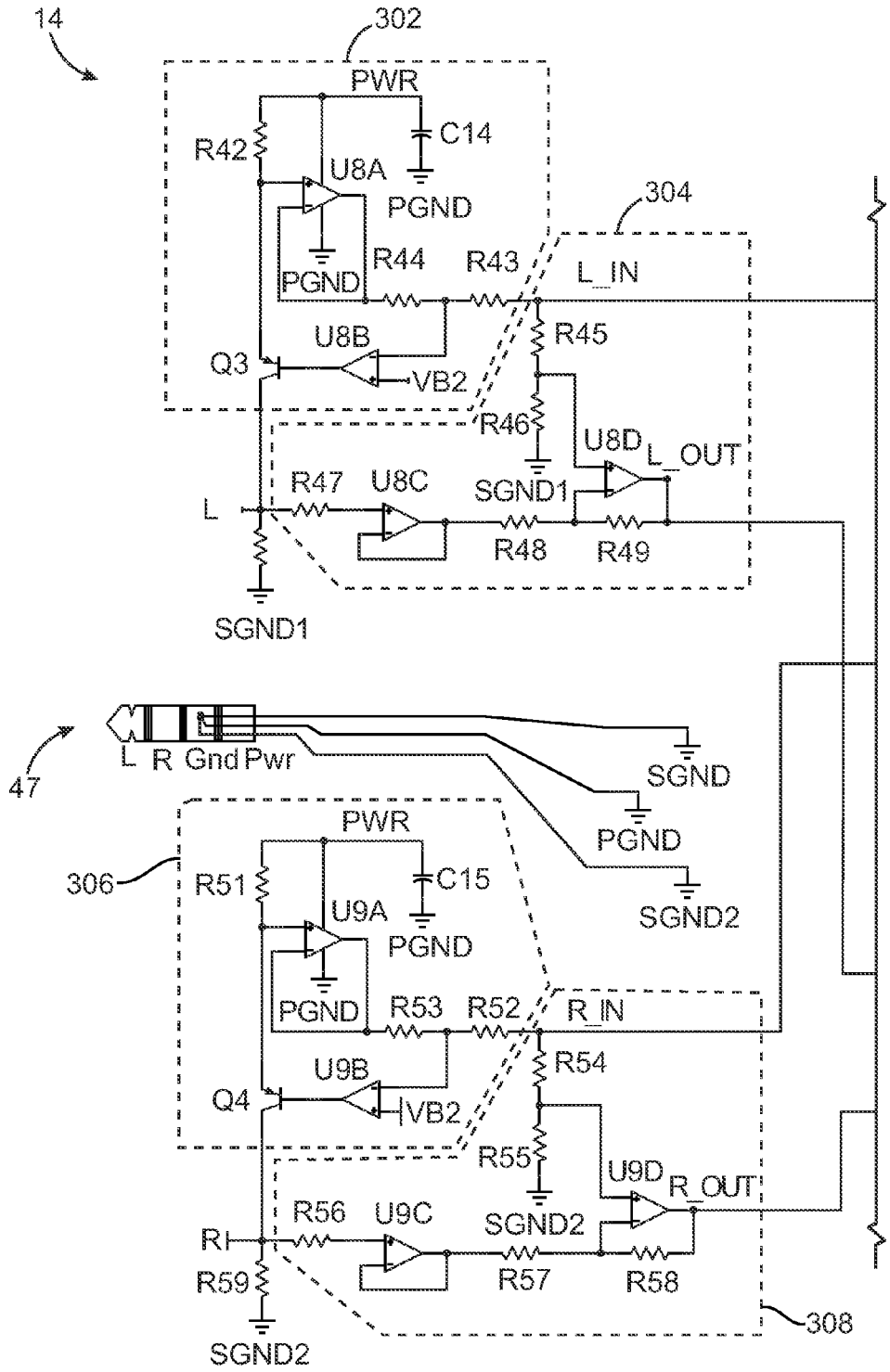
FIG. 7 is a circuit diagram of illustrative circuitry that may be provided as part of an accessory or other electronic equipment that can communicate with an electronic device using hybrid circuits in accordance with an embodiment of the present invention.
Figure 7:
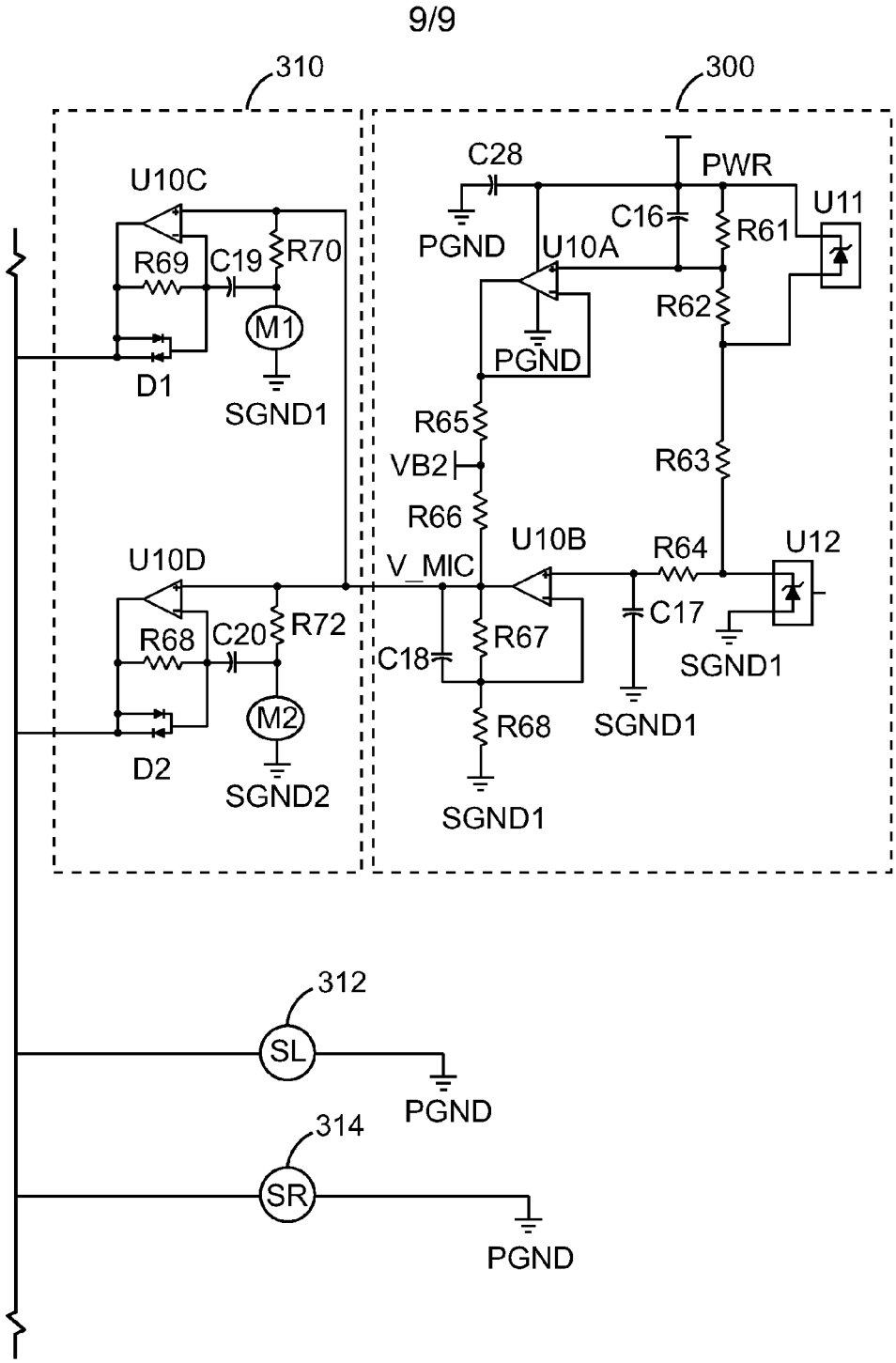

FIG. 7 shows an illustrative circuit configuration in external equipment 14 in which a pair of hybrid circuits can be coupled to the left and right audio lines in path 16 to provide two bidirectional paths between device 12 and external equipment 14. As shown in FIG. 7, hybrid circuit 264 of FIG. 4 may be formed from circuit 302, circuit 304, and from shared circuit 300 (e.g., a circuit that produces a shared reference voltage such as reference voltage VB2 and that produces a microphone bias signal such as V_MIC). Hybrid circuit 266 of FIG. 4 may be formed from circuit 306, circuit 308, and from shared circuit 300.

Shared circuit 300 may generate one or more reference voltages such as reference voltage VB2 for circuits 302 and 306 (as examples). Circuit 300 may receive a power supply voltage PWR from device 12 over path 16 and may generate the reference voltage VB2. With one suitable arrangement, amplifier U10A may produce a signal at its output that is approximately equal to the voltage of the power line PWR–0.75 volts (as one example).

Circuit 300 may include capacitors such as capacitors C28, C16, C17, and C18. With one arrangement, capacitor C28 may help to reduce noise in circuit 300. In general, capacitors C28, C16, C17, and C18 may have any suitable capacitances. The capacitances of these capacitors need not be equal. As one example, capacitors C28, C16, C17, and C18 may each have a capacitance of 1.0 microfarads.

Zener diodes U11 and U12 may provide reference voltage differences in circuit 300. With one suitable arrangement, zener diodes U11 and U12 may be configured to have a breakdown voltage of approximately 1.225 volts.

Circuit 300 may include resistors R61, R62, R63, R64, R65, R66, R67, and R68. In general, the resistors in circuit 300 may have any suitable resistances and each of the resistors may have a different resistance. As one example, the resistors R61, R62, R63, R64, R65, R66, R67, and R68 may have resistances of approximately 118.0 kilohms, 75.0 kilohms, 6.2 kilohms, 44.2 kilohms, 44.2 kilohms, 44.2 kilohms, 13.3 kilohms, and 59.0 kilohms, respectively.

Circuit 300 may also include amplifiers U10A and U10B. Amplifier U10A may be configured as a voltage follower (e.g., the output of amplifier U10A may be connected to its negative input) that produces a voltage approximately equal to the voltage of PWR−0.75 volts. In addition, circuit 300 may include multiple ground points. With one suitable arrangement, circuit 300 may include connections to a signal ground SGND1 in accessory 14 and connections to a power ground PGND in accessory 14. The signal ground SGND1 and the power ground PGND may be connected to signal and power ground lines in path 16 that converge into a single ground line (see, e.g., the FIG. 5 example). This type of arrangement may help to reduce noise of components in accessory 14 that handle signals that can potentially be sensitive to noise on power supply signals. If desired, a second signal ground such as SGND2 may be used in circuit 300 in addition to or instead of the signal ground SGND1.

Circuit 302 may be a part of hybrid circuit 264. In operation, circuit 302 may function as a current source (such as current source 204 of FIG. 3) that produces a current on the left channel (L) audio line in path 16. The current produced by circuit 302 may be proportional to the left channel audio signals (L_IN) generated by the left microphone amplifier in circuit 310. Capacitor C14 may help to reduce noise in circuit 302 and may have any suitable capacitance. As one example, capacitor C14 may have a capacitance of 1.0 microfarads. Circuit 302 may have an amplifier U8A with a positive input connected to the power supply voltage PWR through a resistor such as resistor R42. As one example, resistor R42 may have a resistance of 7.5 kilohms. The amplifier U8A may be configured as a voltage follower with the negative input coupled to the output of the amplifier. With one suitable arrangement, the output and negative input of amplifier U8A may be coupled to the left microphone amplifier in circuit 310 through resistors R43 and R44. Resistors R43 and R44 may have any suitable resistances As one example, resistors R43 and R44 may have resistances of approximately 44.2 kilohms. The amplifier U8A may help to prevent current from power supply line PWR from passing into and through resistor R44 while providing the voltage of its positive input to resistor R44.

Amplifier U8B may be configured as a differential amplifier with a positive input that receives the reference voltage VB2 from circuit 300 and a negative input connected to a node between resistors R43 and R44. With this type of arrangement, when the voltage L_IN from circuit 310 is zero, the output of amplifier U8B may be at (PWR−0.075−VBE (Q3)) volts and the output current of transistor Q3 may be determined by dividing 0.75 volts by the resistance of resistor R42. When the voltage on L_IN from circuit 310 is nonzero, the output of amplifier U8B may be reduced by a given factor equal to the voltage of L_IN multiplied by the resistance of R44 divided by the resistance of R43. The output current of transistor Q3 in this arrangement may be reduced by subtracting the given factor divided by the resistance of resistor R42. The output of circuit 302 (i.e., the current added to left channel audio line L in path 16) may therefore be proportional to the voltage of L_IN with an additional constant (DC) bias current.

Circuit 304 may be another part of hybrid circuit 264. In operation, circuit 304 may receive signals from the left channel audio line L in path 16 and from the output (L_IN) of circuit 310 and may generate left audio channel signals (L_OUT) for the left channel speaker 312. If desired, the left and right channel speakers 312 and 314 may include amplifier circuitry. Resistors R45 and R46 may form an attenuator circuit similar in operation to the attenuator circuit 178 of FIG. 3. In particular, resistors R45 and R46 may reduce the voltage of signals L_IN from circuit 300 to one-fourth its initial voltage and provide the reduced voltage to the positive input of amplifier U8D. In general, resistors R45 and R46 may have any suitable resistances. As one example, resistors R45 and R46 may have resistances of approximately 22.1 kilohms and 44.2 kilohms, respectively.

Circuit 304 may include amplifier U8C coupled to the left audio path (L) in path 16. Amplifier U8C may be configured as a voltage follower (e.g., may have its negative input connected to its output). If desired, there may be a resistor such as resistor R47 located between the left audio path (L) (e.g., the tip connector 45 in accessory 14) and the amplifier U8C. Resistor R47 may provide electrostatic discharge (ESD) protection to device 12. Resistor R47 may have any suitable resistance and, as one example, may have a resistance of 4.7 kilohms.

Amplifier U8D may be configured as a differential amplifier that uses the difference between the voltage on the left audio path (L) and the (attenuated) voltage from the left microphone amplifier in circuit 300 to generate the left audio channel signals L_OUT for the left speaker 312 (e.g., to receive the incoming analog signals from device 12 conveyed on the bidirectional path L). The differential amplifier U8D may have associated resistors R48 and R49. The resistors R48 and R49 may have any suitable resistances and, as one example, resistors R48 and R49 may have resistances of 22.1 kilohms and 44.2 kilohms, respectively.

Circuits 306 and 308 may handle signals carried on the right channel audio path (R) in path 16. For example, circuits 306 and 306 may handle signals (R_IN) output from the right channel microphone amplifier in circuit 310 and may generate the right channel speaker signals (R_OUT) for the right channel speaker 314. With one suitable arrangement (as illustrated in the FIG. 7 example), circuits 306 and 308 may handle signals for the right channel in a manner equivalent to how circuits 302 and 304 handle signals for the left channel. If desired, the capacitance of capacitor C15 may be equivalent to capacitor C14. The resistances of resistors R51, R52, R53, R54, R55, R56, R57, and R58 may be approximately equivalent to the corresponding resistors in circuits 302 and 304. The amplifiers U9A, U9B, U9C, and U9D may be configured in a manner equivalent to amplifiers U8A, U8B, U8C, and U8D, respectively. If desired, transistor Q4 may be similar to (or identical to) transistor Q3.

If desired, accessory 14 may include microphone amplifier circuitry 310. Microphone amplifier circuitry 310 may generate microphone signals that are sent to device 12 using hybrid circuits. Microphone circuitry 310 can include a first microphone M1 and a second microphone M2. With one suitable arrangement, microphone M1 can be located near the left speaker SL and microphone M2 can be located near the right speaker SR to detect ambient noise near the speakers as part of a noise cancellation operation. With another suitable arrangement, microphone M1 can be used to detect a user's voice and microphone M2 can be used to detect ambient noise around microphone M2 as part of a microphone noise cancellation operation.

Circuitry 310 may include circuitry for generating a left microphone signal such as amplifier U10C, resistors R69 and R70, capacitor C19, and transistors D1 coupled to microphone M1. Microphone M1 may be coupled between a first signal ground SGND1 and resistor R70. Resistor R70 may be coupled to the microphone bias line from circuit 300. As an example, resistors R69 and R70 may have resistances of approximately 68.0 kilohms and 2.2 kilohms, respectively. Capacitor C19 may have a capacitance of approximately 1.0 microfarad.

Circuitry 310 may also include circuitry for generating a left microphone signal such as amplifier U10D, resistors R68 and R72, capacitor C20, and transistors D2 coupled to microphone M2. Microphone M2 may be coupled between a second signal ground SGND2 and resistor R72. Resistor R72 may be coupled to the microphone bias line from circuit 300. As an example, resistors R68 and R72 may have resistances of approximately 68.0 kilohms and 2.2 kilohms, respectively. Capacitor C20 may have a capacitance of approximately 1.0 microfarad.

The foregoing is merely illustrative of the principles of this invention and various modifications can be made by those skilled in the art without departing from the scope and spirit of the invention.

What is claimed is:

1. An electronic device that supports communications with electronic equipment, comprising:

an audio connector having four contacts including left channel and right channel audio contacts;

a first hybrid circuit having a common port coupled to the left channel audio contact and having a differential amplifier that receives a shared bias voltage;

a left channel audio output that transmits left channel analog audio signals through the first hybrid circuit;

a left channel microphone input that receives left channel microphone signals from the first hybrid circuit;

a second hybrid circuit having a common port coupled to the right channel audio contact and having a differential amplifier that receives the shared bias voltage;

a right channel audio output that transmits right channel analog audio signals through the second hybrid circuit;

a right channel microphone input that receives right channel microphone signals from the second hybrid circuit; and a shared circuit that generates the shared bias voltage for the first and second hybrid circuits.

2. The electronic device defined in claim 1 further comprising noise cancellation circuitry that reduces noise in speakers that receive the left and right channel audio signals using the left and right channel microphone signals, respectively.

3. The electronic device defined in claim 1 further comprising ground noise sensing circuitry including an amplifier that is coupled to a ground contact in the audio connector.

4. The electronic device defined in claim 3 further comprising audio codec circuitry that includes the left channel audio output, the right channel audio output, and a ground noise input coupled to the ground noise sensing circuitry, wherein the left channel audio output of the audio codec circuitry is coupled to the first hybrid circuit and wherein the right channel audio output of the audio codec circuitry is coupled to the second hybrid circuit.

5. The electronic device defined in claim 1 further comprising power supply circuitry that generates a power supply voltage for the electronic equipment, wherein the power supply circuitry is coupled to a power contact in the audio connector.

6. An accessory comprising:

an audio connector having a left channel audio contact, a right channel audio contact, a power contact, and a ground contact;

at least one hybrid circuit having a common node coupled to one of the audio contacts in the audio connector;

a wired path having a length between the audio connector and the hybrid circuit, wherein the length of the wired path between the audio connector and the hybrid circuit includes separate power ground and signal ground lines and wherein the power ground line and the signal ground line are both coupled to the ground contact in the audio connector;

a summing resistor coupled between the common node and the signal ground line; and circuitry coupled to the power ground line.

7. The accessory defined in claim 6 wherein the at least one hybrid circuit comprises a first hybrid circuit having a common node coupled to the left channel audio contact and a second hybrid circuit having a common node coupled to the right channel audio contact, the accessory further comprising:

a left channel speaker that receives signals from the first hybrid circuit; and a right channel speaker that receives signals from the second hybrid circuit.

8. The accessory defined in claim 7 further comprising:

a left channel microphone that detects left channel ambient noise signals to reduce noise in the left channel speaker; and a right channel microphone that detects right channel ambient noise signals to reduce noise in the right channel speaker.

9. The accessory defined in claim 6 wherein the at least one hybrid circuit comprises:

a first hybrid circuit having a common node coupled to the left channel audio contact and having a differential amplifier that receives a shared bias voltage; and a second hybrid circuit having a common node coupled to the right channel audio contact and having a differential amplifier that receives the shared bias voltage; the accessory further comprising a shared circuit that generates the shared bias voltage for the first and second hybrid circuits.

10. The accessory defined in claim 6 wherein the at least one hybrid circuit comprises:

a first hybrid circuit having a common node coupled to the left channel audio contact and having a differential amplifier that receives a shared bias voltage; and a second hybrid circuit having a common node coupled to the right channel audio contact and having a differential amplifier that receives the shared bias voltage; the accessory further comprising:

a first microphone that receives a common microphone bias signal;

a second microphone that receives the common microphone bias signal; and a shared circuit that generates the shared bias voltage for the first and second hybrid circuits and that generates the common microphone bias signal for the first and second microphones.

11. The accessory defined in claim 6 wherein the length of the wired path includes an additional signal ground line and wherein the at least one hybrid circuit comprises:

a first hybrid circuit having a common node coupled to the left channel audio contact, wherein the first hybrid circuit includes circuitry coupled to the signal ground line; and a second hybrid circuit having a common node coupled to the right channel audio contact, wherein the second hybrid circuit includes circuitry coupled to the additional signal ground line.

12. The accessory defined in claim 11 further comprising:

a left channel speaker that receives signals from the first hybrid circuit and that is coupled to the power ground line; and a right channel speaker that receives signals from the second hybrid circuit and that is coupled to the power ground line.

13. An electronic device that supports communications with electronic equipment, comprising:

an audio connector having a left channel audio contact, a right channel audio contact, a power contact, and a ground contact;

a first hybrid circuit having a common port coupled to the left channel audio contact;

a second hybrid circuit having a common port coupled to the right channel audio contact;

ground noise sensing circuitry including an amplifier that is coupled to the ground contact in the audio connector; and audio codec circuitry having a left channel audio output coupled to the first hybrid circuit, a right channel audio output coupled to the second hybrid circuit, and a ground noise input coupled to the ground noise sensing circuitry.

14. The electronic device defined in claim 13 wherein the first hybrid circuit has a differential amplifier that receives a shared bias voltage and wherein the second hybrid circuit has a differential amplifier that receives a shared bias voltage, the electronic device further comprising a shared circuit that generates the shared bias voltage for the first and second hybrid circuits.

15. The electronic device defined in claim 13 comprising power supply circuitry that generates a power supply voltage for the electronic equipment, wherein the power supply circuitry is coupled to the power contact in the audio connector.

16. The electronic device defined in claim 13 wherein the audio codec circuitry has a left channel audio input coupled to the first hybrid circuit and a right channel audio input coupled to the second hybrid circuit and wherein the audio codec circuitry includes noise cancellation circuitry that reduces noise in speakers that receive signals from the left and right channel audio outputs using signals received on the left and right channel audio inputs.

17. The electronic device defined in claim 13 wherein the audio codec circuitry has a left channel audio input that receives left channel microphone signals from the first hybrid and a right channel audio input that receives right channel microphone signals from the second hybrid.

18. The electronic device defined in claim 13 wherein the amplifier in the ground noise sensing circuitry has an output, a first input coupled to the ground contact, and a second input coupled to the output through a first resistor and wherein the second input is coupled to a ground in the electronic device through a second resistor.

* * * * *

UNITED STATES PATENT AND TRADEMARK OFFICE

CERTIFICATE OF CORRECTION

PATENT NO. : 7,769,187 B1
APPLICATION NO. : 12/503007
DATED : August 3, 2010
INVENTOR(S) : Douglas M. Farrar et al.

It is certified that error appears in the above-identified patent and that said Letters Patent is hereby corrected as shown below:

In column 7, line 66, after "device" insert -- 12 --.

Signed and Sealed this
Eighth Day of November, 2011

David J. Kappos

David J. Kappos
*Director of the United States Patent and Trademark Office*